US011189944B2

(12) United States Patent
Hashiguchi

(10) Patent No.: US 11,189,944 B2
(45) Date of Patent: Nov. 30, 2021

(54) CABLE CONNECTION STRUCTURE AND CABLE JUNCTION CONNECTOR

(71) Applicant: JAPAN AVIATION ELECTRONICS INDUSTRY, LIMITED, Tokyo (JP)

(72) Inventor: Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/695,701

(22) Filed: Nov. 26, 2019

(65) Prior Publication Data

US 2020/0287306 A1 Sep. 10, 2020

(30) Foreign Application Priority Data

Mar. 5, 2019 (JP) ..... JP2019-039365

(51) Int. Cl.
*H01R 12/50* (2011.01)
*H01R 12/67* (2011.01)
*H01R 12/68* (2011.01)
*H01R 12/63* (2011.01)

(52) U.S. Cl.
CPC ..... *H01R 12/675* (2013.01); *H01R 12/63* (2013.01); *H01R 12/68* (2013.01)

(58) Field of Classification Search
CPC ..... H01R 12/675; H01R 12/67; H01R 12/65; H01R 12/61; H01R 12/613; H01R 12/59; H01R 12/51; H01R 12/50; H01R 12/62; H01R 12/63; H01R 12/616; H01R 12/68
USPC ..... 439/406, 407
See application file for complete search history.

(56) References Cited

U.S. PATENT DOCUMENTS 3,829,822 A * 8/1974 Geiser ..... H01R 4/26 439/402
3,964,816 A * 6/1976 Narozny ..... H01R 4/2458 439/397
3,994,554 A * 11/1976 Navarro ..... H01R 12/675 439/406
4,160,574 A * 7/1979 DeRoss ..... H01R 4/2416 439/406
4,188,083 A * 2/1980 Knowles ..... H01R 23/66 439/405

(Continued)

FOREIGN PATENT DOCUMENTS

JP 2012-234688 11/2012

*Primary Examiner* — Harshad C Patel
(74) *Attorney, Agent, or Firm* — Greenblum & Bernstein, P.L.C.

(57) ABSTRACT

A cable connection structure includes a cable, a sheet-like wiring member, and a cable junction connector. The cable junction connector includes a first fitting and a second fitting. A connection portion of the first fitting and a connection portion of the second fitting interlock with each other in a state in which a part of a conductor formed on the sheet-like wiring member is sandwiched between a plate portion of the first fitting and a plate portion of the second fitting. The first fitting has an insulation-displacement contact which includes an open-ended slot. The cable is forced into the open-ended slot. A direction in which the cable is forced into the open-ended slot is perpendicular to a direction in which the cable extends and is parallel to a direction in which the part of the conductor is sandwiched between the plate portion of the first fitting and the plate portion of the second fitting.

8 Claims, 12 Drawing Sheets

(56) References Cited

U.S. PATENT DOCUMENTS

| | | | | | |
|---|---|---|---|---|---|
| 4,481,710 | A * | 11/1984 | Caveney | H01R 43/01 | 29/749 |
| 4,533,199 | A * | 8/1985 | Feldberg | H01R 4/2433 | 29/838 |
| 6,036,531 | A * | 3/2000 | Lee | H01R 12/675 | 439/405 |
| 6,062,896 | A * | 5/2000 | Huang | H01R 12/675 | 439/405 |
| 6,398,581 | B1 * | 6/2002 | Baier | H01R 12/616 | 439/404 |
| 6,817,887 | B2 * | 11/2004 | Jones | H01R 13/6275 | 439/405 |
| 7,077,687 | B1 * | 7/2006 | Feistkorn | H01R 12/53 | 439/399 |
| 8,109,783 | B2 * | 2/2012 | Bishop | H01R 4/2433 | 439/404 |
| 8,277,245 | B2 * | 10/2012 | Fix | H02G 3/32 | 439/497 |
| 8,684,761 | B2 * | 4/2014 | Weaver | H01R 4/242 | 439/404 |
| 9,543,664 | B2 * | 1/2017 | Sabo | H01R 4/2429 | |
| 9,543,665 | B2 * | 1/2017 | Sabo | H01R 4/2433 | |
| 10,886,639 | B2 * | 1/2021 | Hata | H01R 13/5216 | |

* cited by examiner

CABLE CONNECTION STRUCTURE AND CABLE JUNCTION CONNECTOR

TECHNICAL FIELD

The present invention relates to a cable connection structure that connects, by using a cable junction connector, a cable to a conductor of a sheet-like wiring member and a cable junction connector that is used in the cable connection structure.

BACKGROUND ART

FIG. 1A illustrates a cable connection structure which is described in Japanese Patent Application Laid Open No. 2012-234688. FIG. 1B illustrates the structure of a connecting member illustrated in FIG. 1A. In this example, a connecting member 10 electrically connects a conductive fabric 20 to a cable 30.

The connecting member 10 includes a first member 11 and a second member 12. The first member 11 includes a main body 11*a*, a planar conductive portion 11*b*, and projections 11*c* electrically connected to the conductive portion 11*b* and projecting from the conductive portion 11*b*.

The second member 12 includes a main body 12*a*, an overlap portion 12*b* that overlaps with the conductive portion 11*b*, and a fixing portion 12*c* to which the cable 30 is fixed. The first member 11 and the second member 12 are coupled to each other by a hinge portion 13.

The conductive fabric 20 includes a conductive thread 22 and a fabric 21 into which the conductive thread 22 is woven. The conductive thread 22 is partially exposed from an end of the fabric 21.

As a result of the connecting member 10 being folded at the hinge portion 13, the conductive portion 11*b* and the overlap portion 12*b* overlap one another. The fabric 21 and the conductive thread 22 partially exposed from the end of the fabric 21 are sandwiched between the conductive portion 11*b* and the overlap portion 12*b*. As a result, the conductive portion 11*b* and the conductive thread 22 come into contact with each other. The projections 11*c* pass through the fabric 21 and a covering portion 31 of the cable 30 fixed to the fixing portion 12*c*, whereby the projections 11*c* come into contact with a conductor portion 32 of the cable 30.

In this example, electrical connection between the conductive fabric 20 and the cable 30 and fixation of the conductive fabric 20 are implemented.

In the above-described cable connection structure, the following operations have to be performed in sequence when the conductive fabric 20 and the cable 30 are connected to each other using the connecting member 10, which results in poor workability.

(1) The conductive fabric 20 is attached to the conductive portion 11*b*.

(2) The cable 30 is fixed to the fixing portion 12*c*.

(3) The connecting member 10 is folded at the hinge portion 13 to make the overlap portion 12*b* overlap with the conductive portion 11*b*.

BRIEF SUMMARY OF THE INVENTION

An object of the present invention is to provide a cable connection structure with good connection workability and a cable junction connector that is used in the cable connection structure.

The following technical matters are described simply to facilitate the understanding of the main points of the present invention, not to limit the invention claimed in the claims explicitly or implicitly and express the possibility of accepting such a limitation that is imposed by a person other than those who will benefit from the present invention (for example, the applicant and the right holder). The general outline of the present invention described from other perspectives can be understood from, for example, the claims of this application as originally filed at the time of application.

A cable junction connector of the present invention is a connector including a cable connection portion formed with a slot for receiving an electric cable and is a type of connector which is called an insulation-displacement connector, an insulation-piercing connector, a solderless terminal, a solderless connector, a quick splice, or the like by those skilled in the art.

The cable junction connector of the present invention has two fittings provided with a structure in which a sheet-like wiring member with a front surface on which a conductor is formed is sandwiched between the two fittings. A first fitting has an insulation-displacement contact which includes an open-ended slot. A direction in which the cable is forced into the open-ended slot is perpendicular to a direction in which the cable extends and is parallel to a direction in which the conductor formed on the front surface of the sheet-like wiring member is sandwiched between a plate portion of the first fitting and a plate portion of a second fitting.

The cable connection structure in which the cable is connected to the sheet-like wiring member is obtained by pressing the first fitting, the second fitting, and the cable against one another in a state in which the sheet-like wiring member is sandwiched between the first fitting and the second fitting.

These and other objects, features and advantages of the present invention will become apparent from the detailed description taken in conjunction with the accompanying drawings.

Effects of the Invention

According to the present invention, since a cable connection structure in which a conductor formed on a sheet-like wiring member and a cable are electrically connected to each other is obtained by one press operation, a good connection operation is implemented.

BRIEF DESCRIPTION OF THE DRAWINGS

The subject matter, which is regarded as the invention, is particularly pointed out and distinctly claimed in the claims at the conclusion of the specification. The present invention itself, and manner in which it may be made or used, if any, may be better understood after a review of the following description in connection with the accompanying drawings in which:

and

Figure 12:
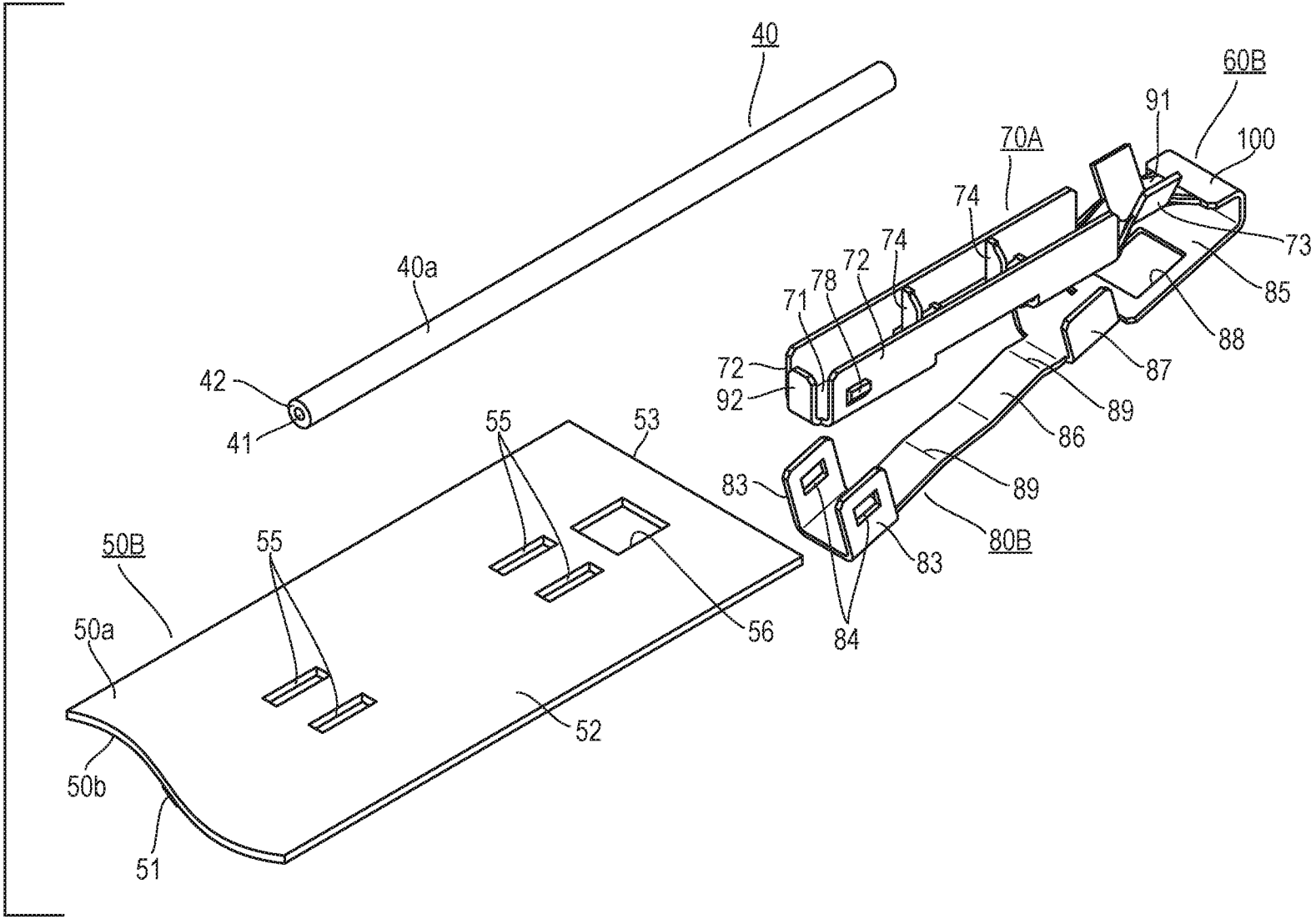

FIG. 12 is an exploded perspective view of the cable connection structure of the fourth embodiment.

DETAILED DESCRIPTION

First Embodiment

Figure 1A:
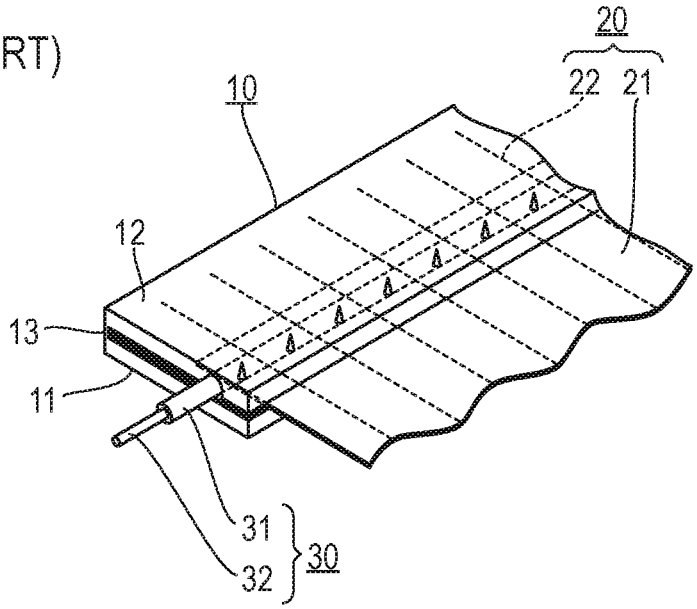
FIG. 1A (PRIOR ART)
FIG. 1A is a perspective view of an existing example of a cable connection structure.
Figure 1B:
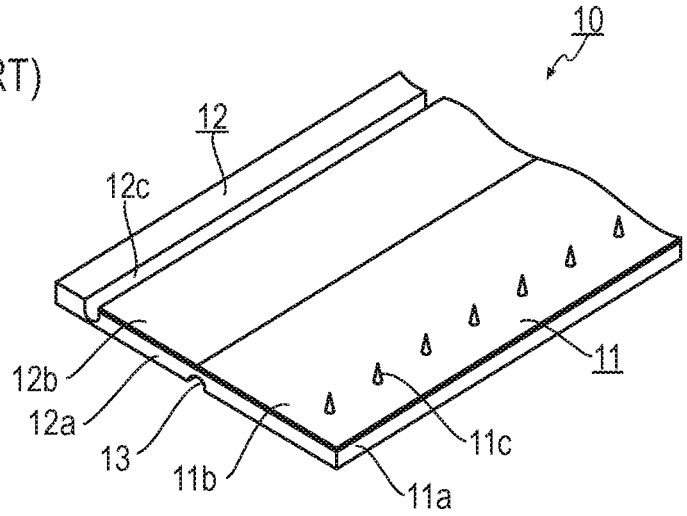
FIG. 1B (PRIOR ART)
FIG. 1B is a perspective view of the structure illustrated in FIG. 1A.
Figure 2:
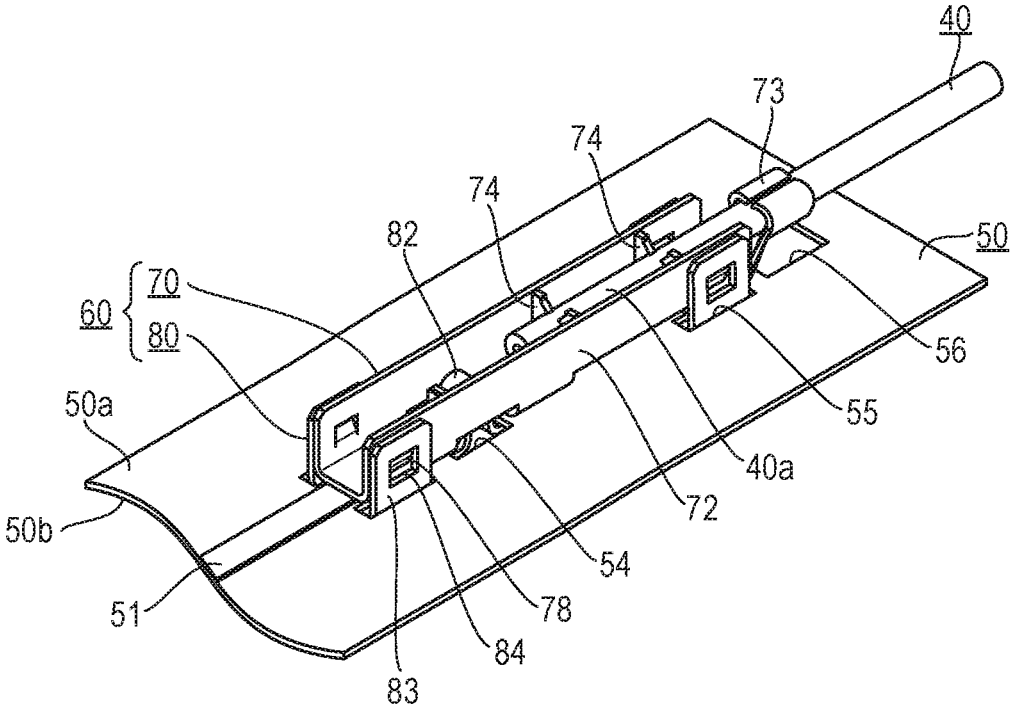
FIG. 2 is a perspective view of a cable connection structure of a first embodiment.
Figure 3A:
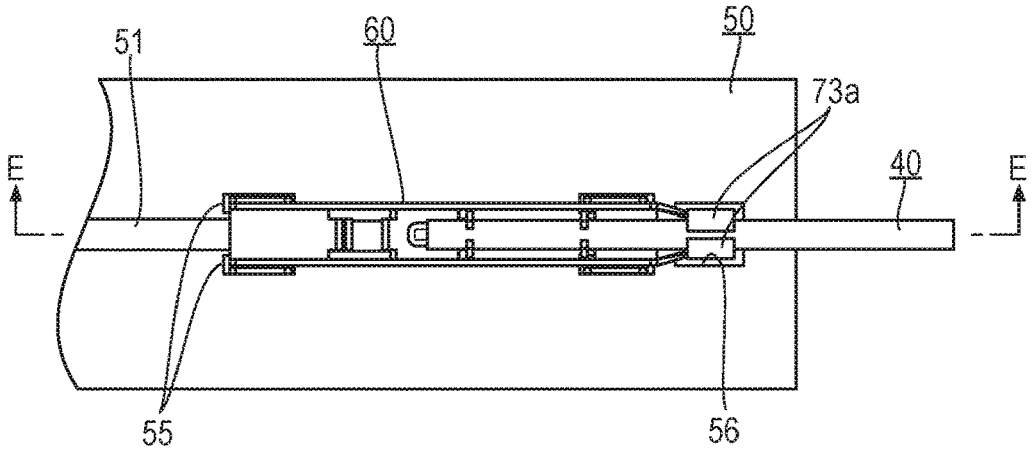
FIG. 3A is a plan view of the cable connection structure of the first embodiment.
Figure 3B:
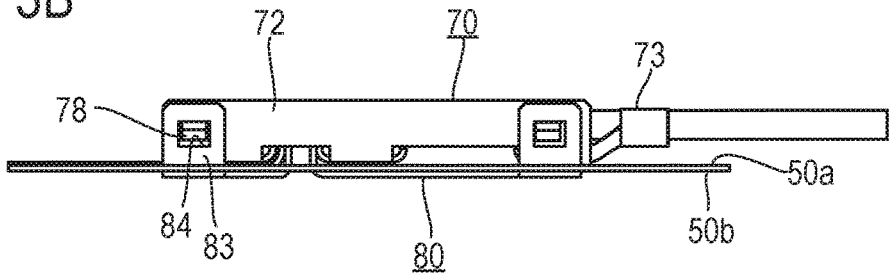
FIG. 3B is a front view of the cable connection structure of the first embodiment.
Figure 3C:
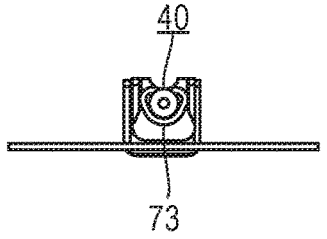
FIG. 3C is a right side view of the cable connection structure of the first embodiment.
Figure 3D:
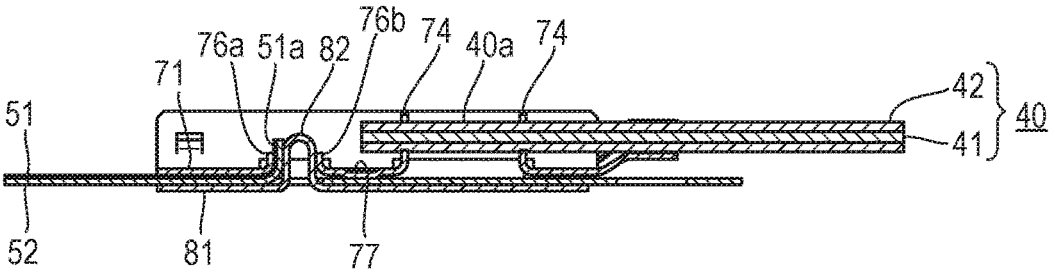
FIG. 3D is a sectional view taken along the line E-E in FIG. 3A.
Figure 4:
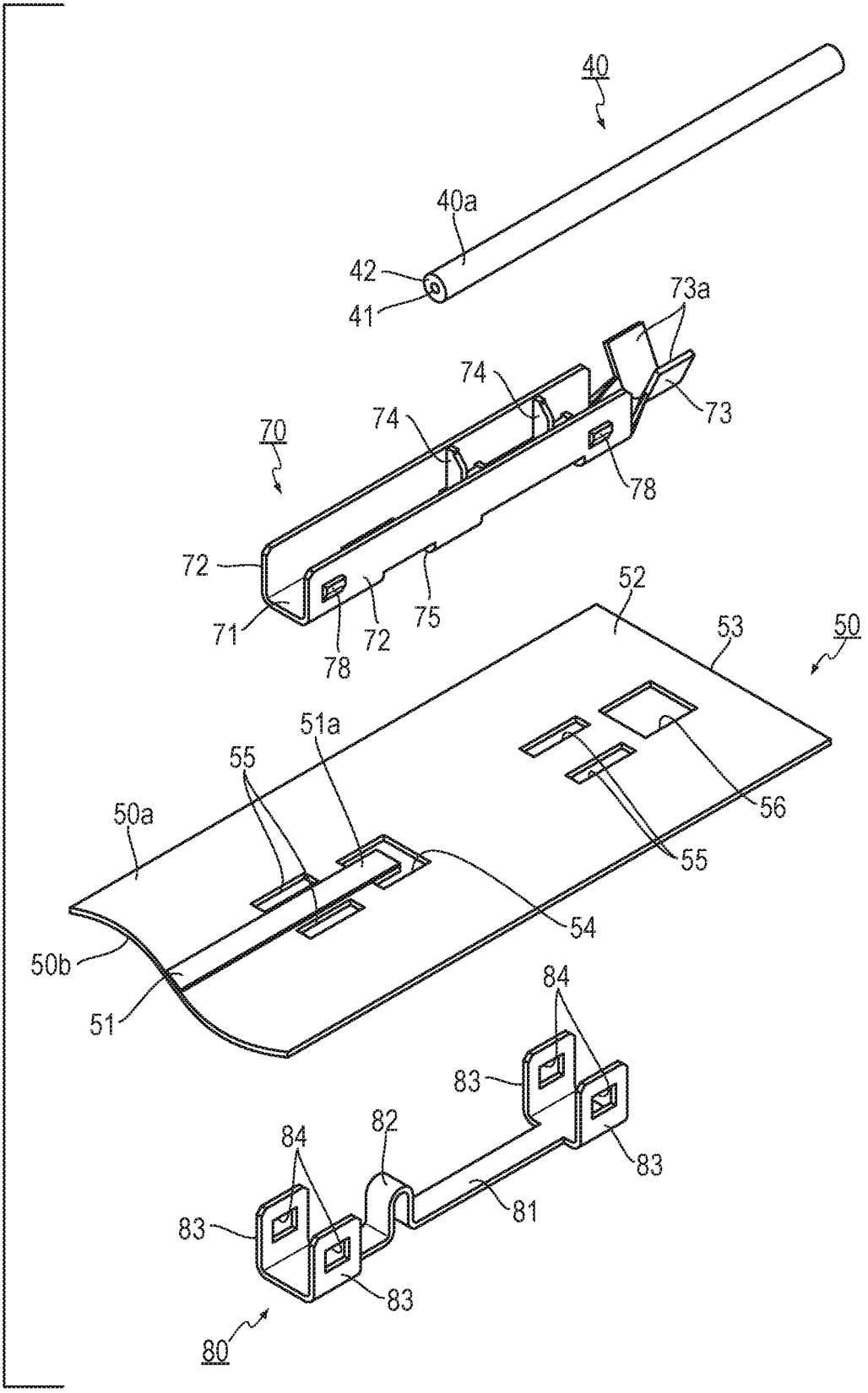
FIG. 4 is an exploded perspective view of the cable connection structure of the first embodiment.
Figure 5A:
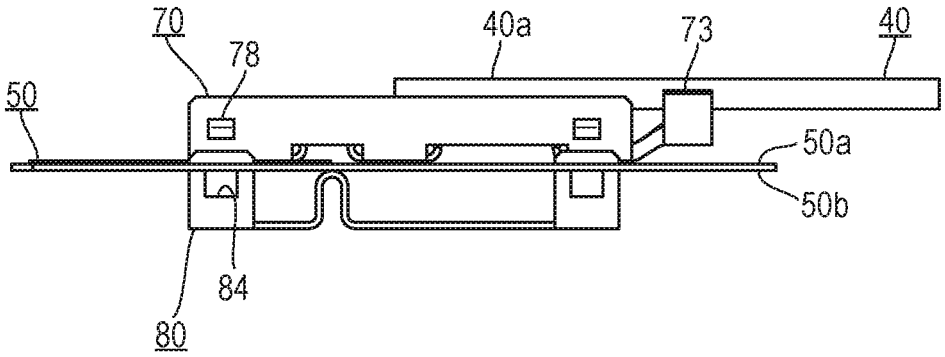
FIG. 5A is a front view of the cable connection structure of the first embodiment in a connecting process.
Figure 5B:
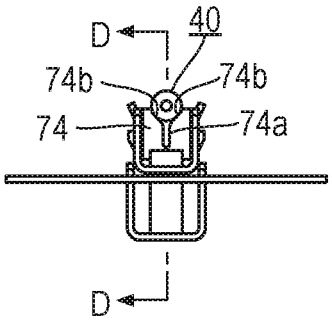
FIG. 5B is a left side view of the structure illustrated in FIG. 5A.
Figure 5C:
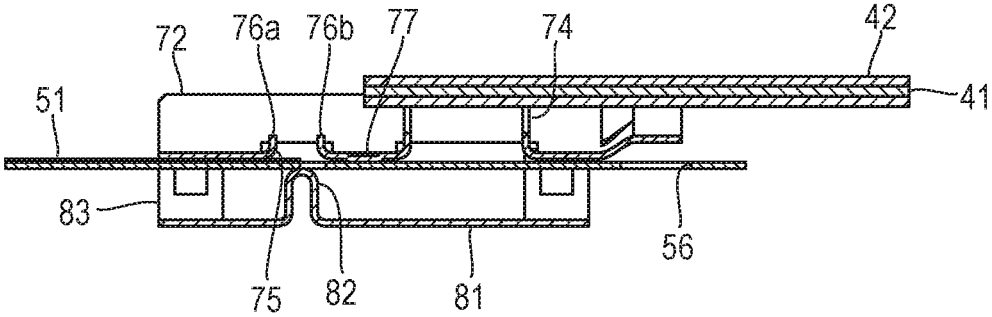
FIG. 5C is a sectional view taken along the line D-D in FIG. 5B.

FIGS. 2 and 3A to 3D illustrate a cable connection structure of a first embodiment. A cable 40 is an insulated wire, for example, and is connected by a cable junction connector 60 to a conductor 51 formed on a sheet-like wiring member 50. FIG. 4 is an exploded view of the cable connection structure illustrated in FIG. 2. FIGS. 5A to 5C illustrate a state in the process of connecting the cable 40 to the wiring member 50.

The cable junction connector 60 and the wiring member 50 will be described with reference to FIGS. 4 and 5A to 5C. The cable junction connector 60 is made up of two parts: an upper fitting 70 which is a first fitting and a lower fitting 80 which is a second fitting. In this example, each of the upper fitting 70 and the lower fitting 80 is made from one metal plate by sheet-metal working or press working. The metal plate is a phosphor bronze plate, for instance.

The upper fitting 70 includes a long and narrow bottom plate portion 71, side plate portions 72 standing upright on both sides of the bottom plate portion 71 in a longitudinal direction thereof, an insulation barrel 73 extending backward from the rear end of the bottom plate portion 71 in the longitudinal direction thereof, two insulation-displacement contacts 74 formed between the two side plate portions 72, an insertion hole 75 formed in the bottom plate portion 71, and two contact pieces 76*a* and 76*b* standing at the edge of the insertion hole 75. The two side plate portions 72 stand in the same direction when viewed from the bottom plate portion 71. The insertion hole 75 is located in a position closer to the front than the two insulation-displacement contacts 74 in the longitudinal direction of the bottom plate portion 71. The two contact pieces 76*a* and 76*b* are cut and raised from the bottom plate portion 71 toward the inside of the upper fitting 70 and face each other in the longitudinal direction of the bottom plate portion 71.

Each of the two insulation-displacement contacts 74 has an open-ended slot 74*a*. The open-ended slot 74*a* is formed in a plate-like portion cut and raised vertically from the bottom plate portion 71 toward the inside of the upper fitting 70. The open-ended slot 74*a* is closed at one end thereof located close to the bottom plate portion 71 and is open at the other end toward the upper side of the upper fitting 70, that is, the outside of the upper fitting 70. On both sides of the other end of the open-ended slot, that is, the open end thereof, inclined surfaces 74*b* are formed, which increases the width of the open-ended slot 74*a* near the open end. Each insulation-displacement contact 74 is also called an insulation-piercing contact, or the like by those skilled in the art.

The height of each of the two contact pieces 76*a* and 76*b* is lower than the height of the insulation-displacement contact 74. In the bottom plate portion 71 between the insulation-displacement contact 74 and the contact piece 76*b*, which is located in a position closer to the two insulation-displacement contacts 74, of the two contact pieces 76*a* and 76*b*, a protruding portion 77 slightly protruding downward from the upper fitting 70 is formed.

At both ends of one side plate portion 72 in a longitudinal direction thereof, hooks 78 protruding toward the outside of the upper fitting 70 are cut and raised. Likewise, at both ends of the other side plate portion 72 in a longitudinal direction thereof, hooks 78 protruding toward the outside of the upper fitting 70 are cut and raised. The insulation barrel 73 has a pair of crimp wings 73*a* which are outstretched upward in a state in which the crimp wings 73*a* face each other.

The lower fitting 80 includes a long and narrow plate portion 81, a protrusion 82 protruding toward the upper side of the lower fitting 80, and four locking pieces 83. The protrusion 82 is formed by bending an intermediate portion of the plate portion 81 in a longitudinal direction thereof in the shape of an inverted U. Two of the four locking pieces 83 are located at one end of the plate portion 81 in the longitudinal direction thereof and face each other in a width direction of the plate portion 81, that is, a direction perpendicular to the longitudinal direction of the plate portion 81. The other two of the four locking pieces 83 are located at the other end of the plate portion 81 in the longitudinal direction thereof and face each other in the width direction of the plate portion 81. The four locking pieces 83 extend in the same direction as a direction in which the protrusion 82 is protruding.

The width of the plate portion 81 in an area in which the locking pieces 83 are located is somewhat larger than the width of the plate portion 81 in the other area. A square-shaped window 84 is formed in each locking piece 83.

In this example, the wiring member 50 includes a base 52, which is a fabric, and the linear conductor 51 formed on the base 52. The whole of the wiring member 50 is not illustrated in the drawings and only principal portions, to which the cable 40 is connected, of the wiring member 50 are illustrated.

As illustrated in FIG. 4, a connection end 51*a*, to which the cable 40 is connected, of the conductor 51 is located inside the wiring member 50 within an edge 53 of the wiring member 50. A staple-shaped hole 54, by which the connection end 51*a* is enclosed on three sides when the base 52 is viewed from above, is formed in the wiring member 50. This allows the connection end 51*a* to be deformed by external forces. Furthermore, four slot-like positioning holes 55 and a hole for passage 56 for passage of a crimp tool are formed in the wiring member 50.

Two of the four positioning holes 55 are located on both sides of the conductor 51 so as to be symmetric about the conductor 51. The other two of the four positioning holes 55 are located between the connection end 51*a* and the edge 53; to be more specific, the other two of the four positioning holes 55 are located on both sides of a virtual extended line of the conductor 51 so as to be symmetric about the virtual extended line of the conductor 51. The hole for passage 56 is formed between the two positioning holes 55, which are close to the edge 53, and the edge 53.

Next, interconnection between the cable 40 and the wiring member 50, which is established by using the cable junction connector 60, will be described.

As illustrated in FIGS. 5A to 5C, the upper fitting 70 is disposed on an upper surface 50*a* on which the conductor 51 of the wiring member 50 is located, and the lower fitting 80 is disposed on a lower surface 50*b* of the wiring member 50. The four locking pieces 83 of the lower fitting 80 are inserted into the four positioning holes 55 of the wiring member 50. In an initial state of insertion, the locking pieces 83 slightly protrude from the upper surface 50*a* of the wiring member 50. The side plate portions 72 are sandwiched by the four locking pieces 83 protruding from the upper surface 50*a* of the wiring member 50; consequently, the upper fitting 70 is positioned with respect to the lower fitting 80 in a width direction of the upper fitting 70, that is, a direction perpendicular to the longitudinal direction of the bottom plate portion 71.

As illustrated in FIGS. 5A to 5C, an end 40*a* of the cable 40 is disposed between the two side plate portions 72 of the upper fitting 70. The cable 40 includes a core 41, which is a linear conductor, and a covering 42 that covers the core 41.

By vertically pushing the lower fitting 80, the upper fitting 70, and the cable 40 into one another in a state in which the lower fitting 80, the wiring member 50, the upper fitting 70, and the cable 40 are vertically stacked in this way, it is possible to connect the parts, that is, the lower fitting 80, the wiring member 50, the upper fitting 70, and the cable 40 to one another all at once. As a result, the cable connection structure illustrated in FIGS. 2 and 3A to 3D is obtained.

The cable 40 is pushed between the two side plate portions 72 from the upper side of the upper fitting 70. As a result, the covering 42 is cut by the insulation-displacement contacts 74 and the core 41 is inserted into the open-ended slots 74*a* of the insulation-displacement contacts 74. By vertically moving a crimp tool for crimping the insulation barrel 73 with the vertical movement of a compression tool for forming a compression joint between the lower fitting 80, the wiring member 50, the upper fitting 70, and the cable 40 when the cable 40 is pushed between the two side plate portions 72, it is possible to crimp the crimp wings 73*a* of the insulation barrel 73. In this way, fixation of the cable 40 to the upper fitting 70 and slitting of the covering 42 by the insulation-displacement contacts 74 are carried out simultaneously. Since the hole for passage 56 for passage of the crimp tool is formed in the wiring member 50, it is possible to perform a crimp operation with ease. However, depending on the use and type of the crimp tool, the hole for passage 56 is not an indispensable element.

As a result of the upper fitting 70 and the lower fitting 80 being pushed into each other, the four hooks 78 are engaged in the four windows 84. As a result, a mechanical coupling structure of the upper fitting 70 and the lower fitting 80, in other words, an interlocked structure is implemented, and this mechanical coupling structure is fixed to the wiring member 50 that is sandwiched between the upper fitting 70 and the lower fitting 80.

The connection end 51*a* of the conductor 51 is pressed by the protrusion 82 of the lower fitting 80. The connection end 51*a* is deformed, that is, bent along with one region of the base 52 supporting the connection end 51*a* and then enters between the two contact pieces 76*a* and 76*b* through the insertion hole 75 along with the one region and the protrusion 82. As a result, the connection end 51*a* and the one region of the base 52 are sandwiched between the protrusion 82 and one contact piece 76*a*, that is, the contact piece 76*a* located in the front of the bottom plate portion 71 in the longitudinal direction thereof as illustrated in FIG. 3D. The connection end 51*a* is pressed against the contact piece 76*a* by the elasticity of the protrusion 82 deformed when entering the insertion hole 75. Therefore, the conductor 51 and the cable 40 are electrically connected to each other via the upper fitting 70 of the cable junction connector 60.

The cable junction connector 60 that is attached to the wiring member 50 by mechanical coupling between the upper fitting 70 and the lower fitting 80 is positioned with respect to the wiring member 50 by the positioning holes 55 of the wiring member 50. Furthermore, since frictional force is generated as a result of the wiring member 50 being sandwiched between the bottom plate portion 71 of the upper fitting 70 and the plate portion 81 of the lower fitting 80 and strong frictional force is generated as a result of the protruding portion 77 of the upper fitting 70 pressing the wiring member 50 hard against the plate portion 81 of the lower fitting 80, the cable junction connector 60 is firmly fixed to the wiring member 50.

As described above, the cable connection structure in which the cable 40 is connected to the wiring member 50 is obtained by pushing the lower fitting 80, the upper fitting 70, and the cable 40 into one another vertically, or in one direction, in a state in which the wiring member 50 is sandwiched between the lower fitting 80 and the upper fitting 70, or is obtained by one simple operation.

The insulation-displacement contacts 74 of the cable junction connector 60 are located between the two side plate portions 72 and therefore exposed parts of the cable 40, from which the covering has been stripped off by the insulation-displacement contacts 74, are protected by the two side plate portions 72, which prevents the occurrence of trouble such as deformation of the exposed parts of the cable 40 caused by something that touches the exposed parts.

Second Embodiment

Figure 6A:
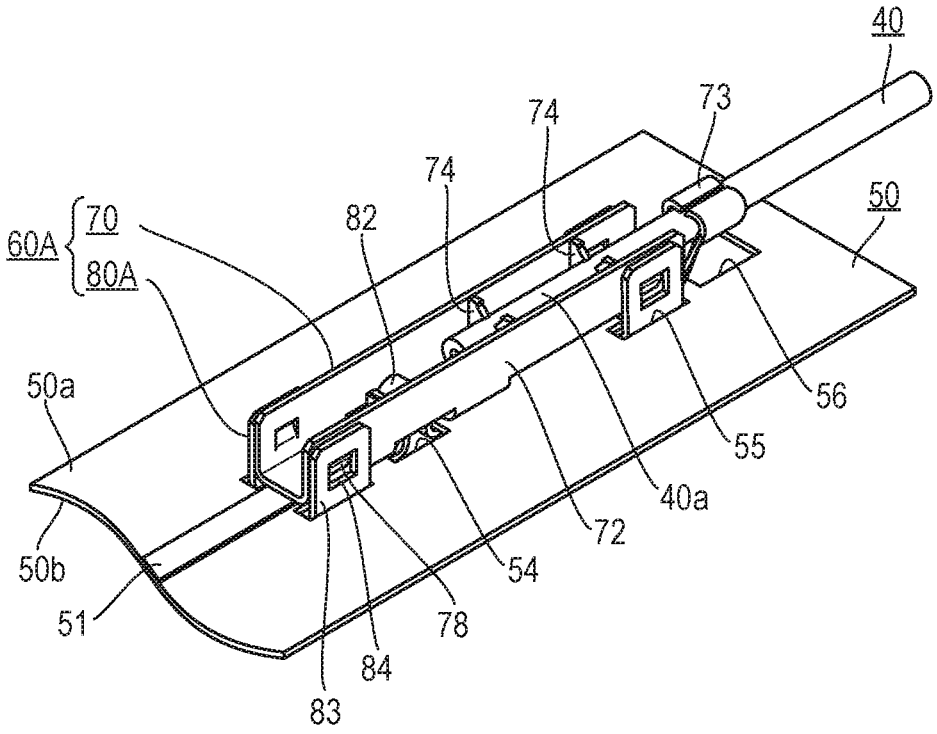
FIG. 6A is a perspective view of a cable connection structure of a second embodiment.
Figure 6B:
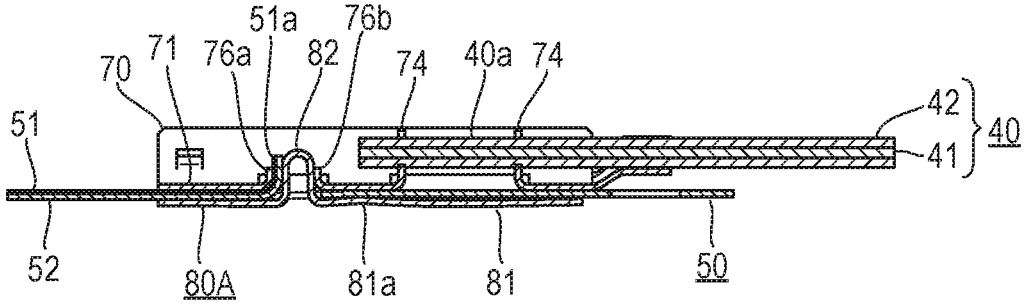
FIG. 6B is a sectional view of the cable connection structure of the second embodiment.
Figure 7:
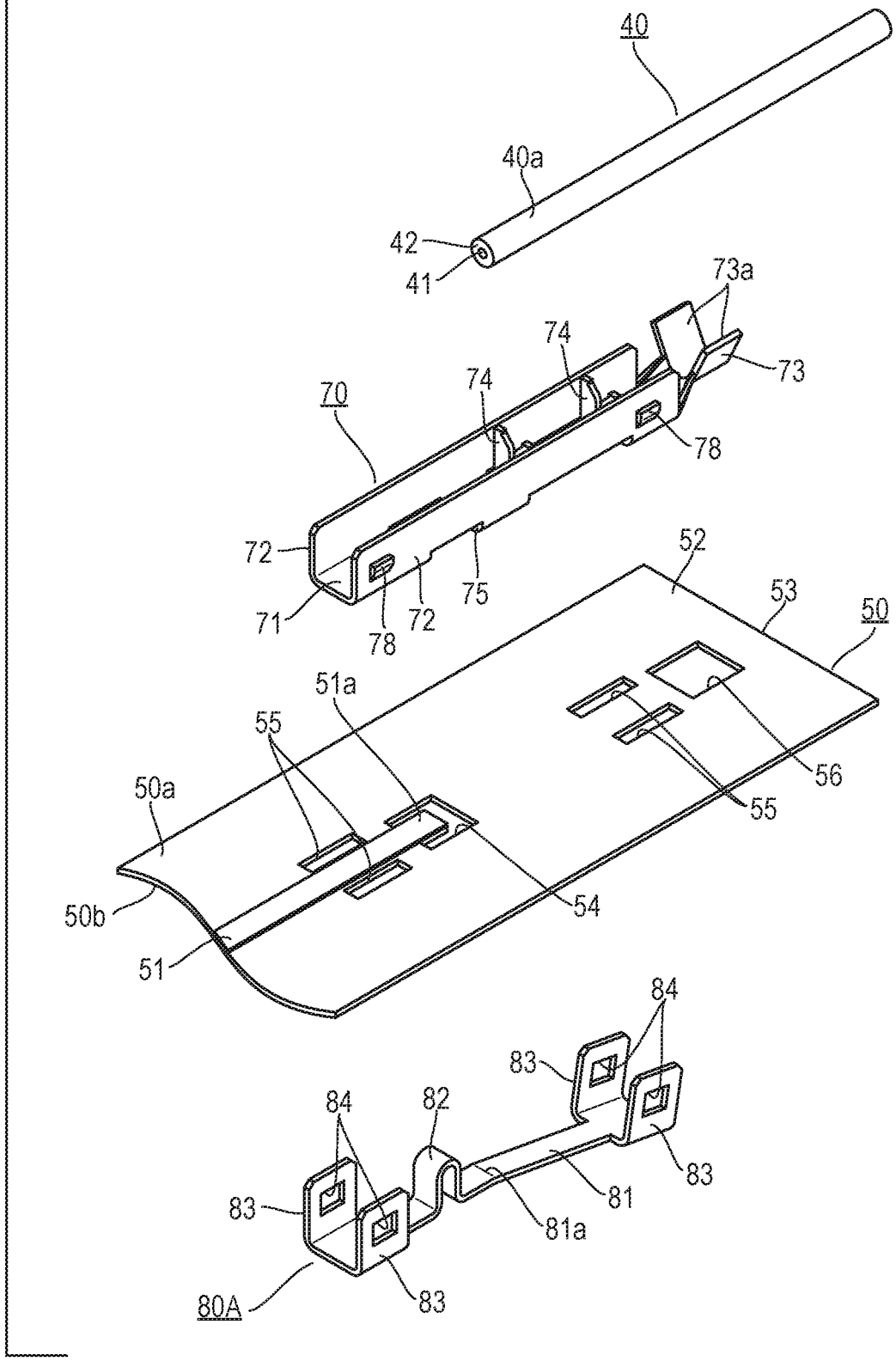
FIG. 7 is an exploded perspective view of the cable connection structure of the second embodiment.
Figure 8A:
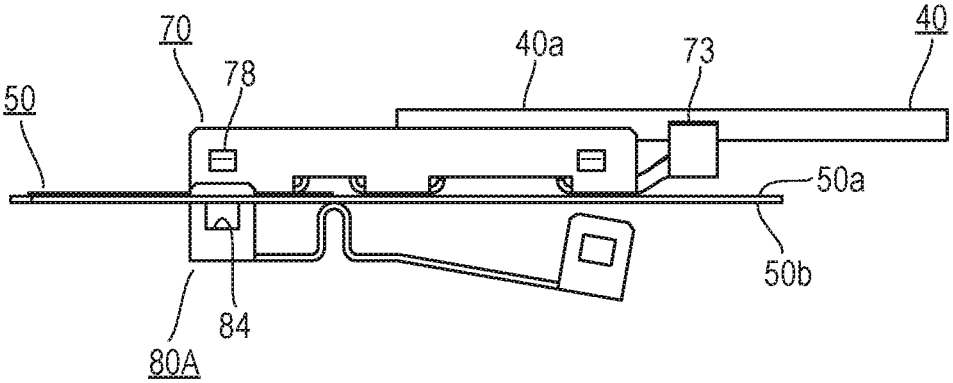
FIG. 8A is a front view of the cable connection structure of the second embodiment in a connecting process.
Figure 8B:
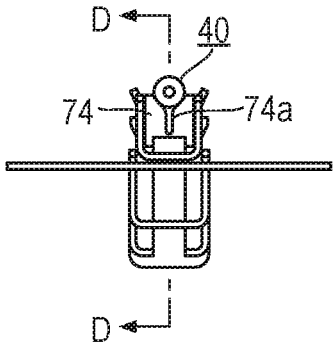
FIG. 8B is a left side view of the structure illustrated in FIG. 8A.
Figure 8C:
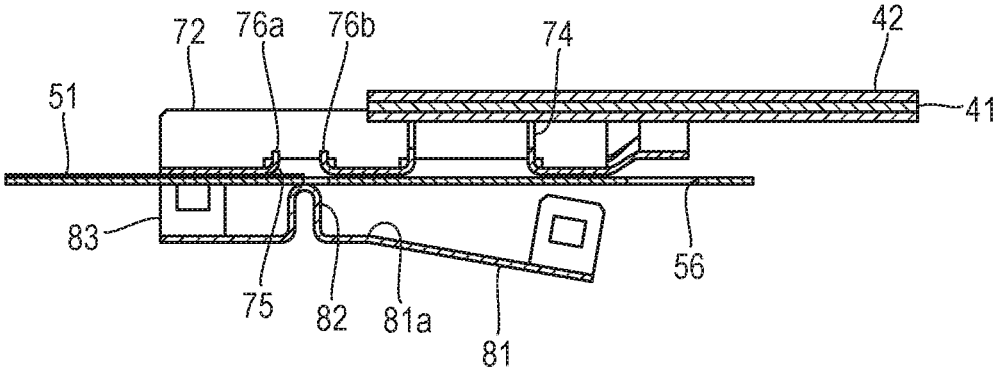
FIG. 8C is a sectional view taken along the line D-D in FIG. 8B.

FIGS. 6A and 6B illustrate a cable connection structure of a second embodiment. FIG. 7 is an exploded view of the cable connection structure illustrated in FIGS. 6A and 6B. FIGS. 8A to 8C illustrate a state in the process of connecting a cable to a wiring member.

The cable connection structure of the second embodiment is identical to the cable connection structure of the first embodiment except for the shape of a lower fitting. Therefore, common parts and portions of the first embodiment and the second embodiment are identified with the same reference characters and detailed explanations thereof are omitted. The same goes for third and fourth embodiments, which will be described later.

In the second embodiment, a bent portion 81*a* is formed in a plate portion 81 of a lower fitting 80A. The bent portion 81*a* is located between a protrusion 82 and the rear end of the plate portion 81, which is close to an insulation barrel 73 of an upper fitting 70. The bent portion 81*a* causes the plate portion 81 to become warped, and the rear end of the plate portion 81 is away from a wiring member 50.

Since the plate portion 81 is bent, it is possible to sandwich the wiring member 50 by a cable junction connector 60A by stronger force compared to the first embodiment and thereby fix the cable junction connector 60A to the wiring member 50 more firmly.

Third Embodiment

Figure 9A:
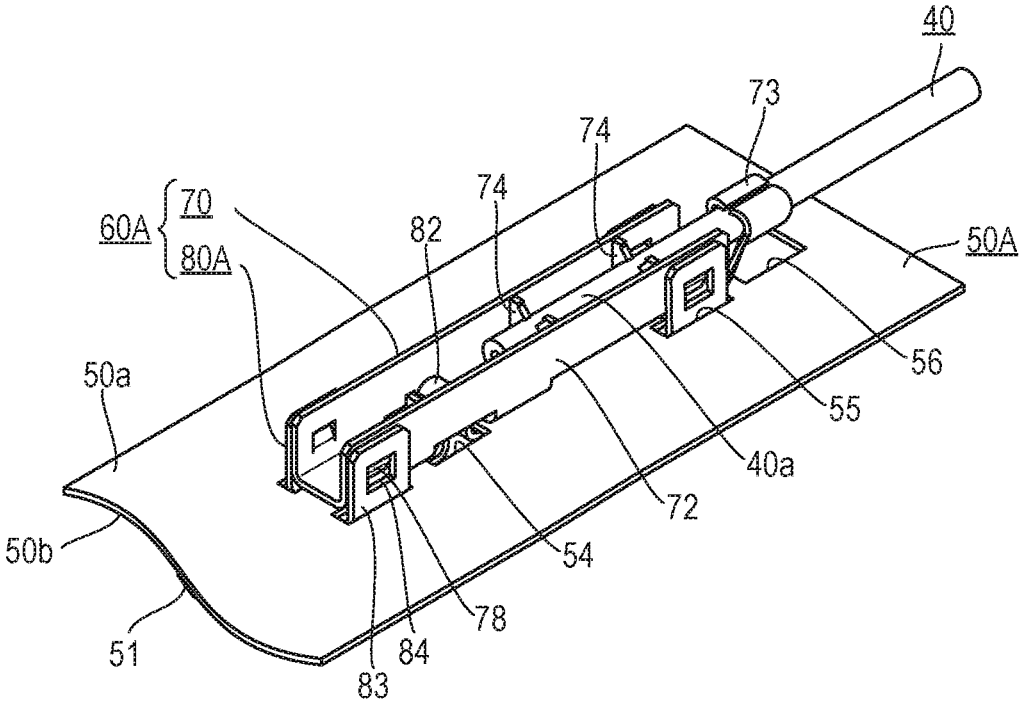
FIG. 9A is a perspective view of a cable connection structure of a third embodiment.
Figure 9B:
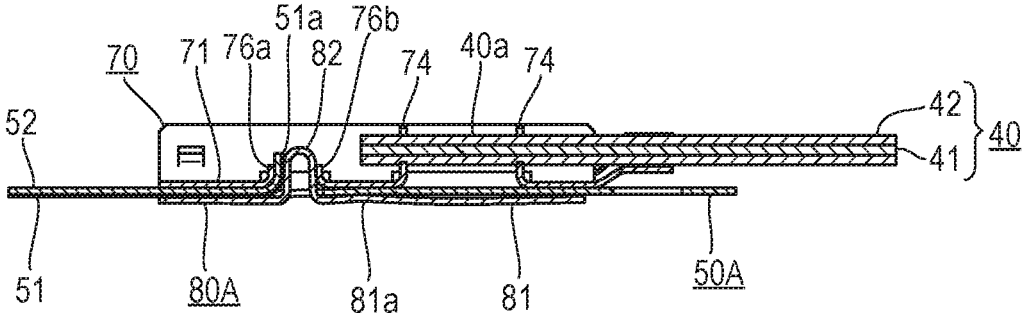
FIG. 9B is a sectional view of the cable connection structure of the third embodiment.
Figure 10A:
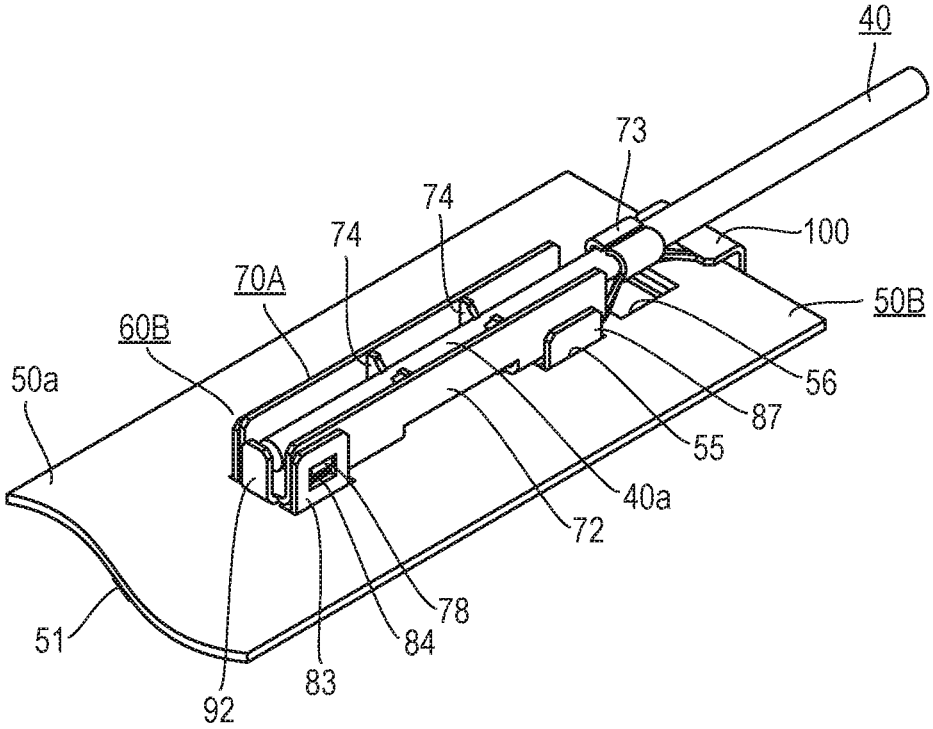
FIG. 10A is a top perspective view of a cable connection structure of a fourth embodiment.
Figure 10B:
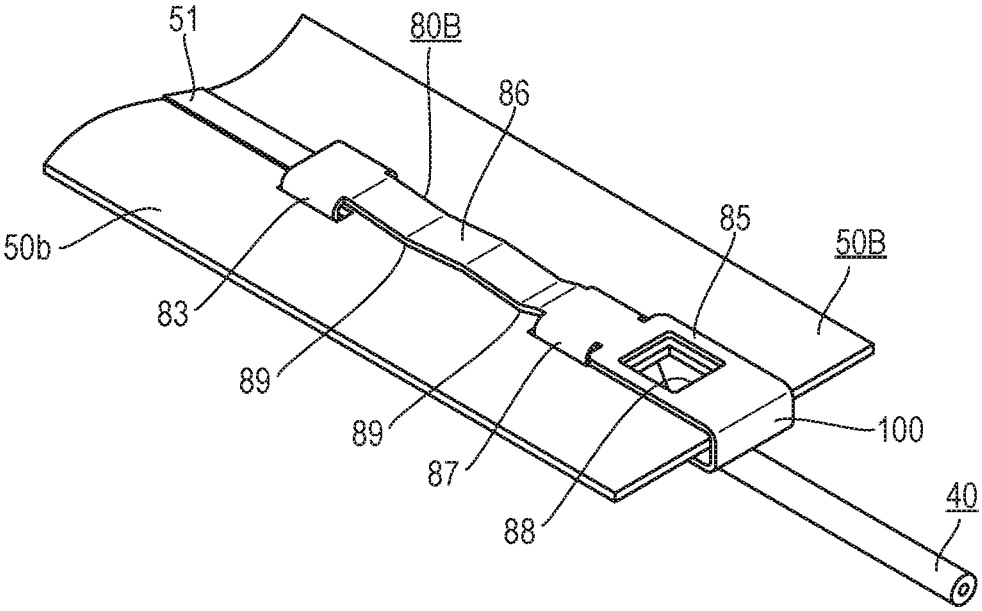
FIG. 10B is a bottom perspective view of the cable connection structure of the fourth embodiment.
Figure 11A:
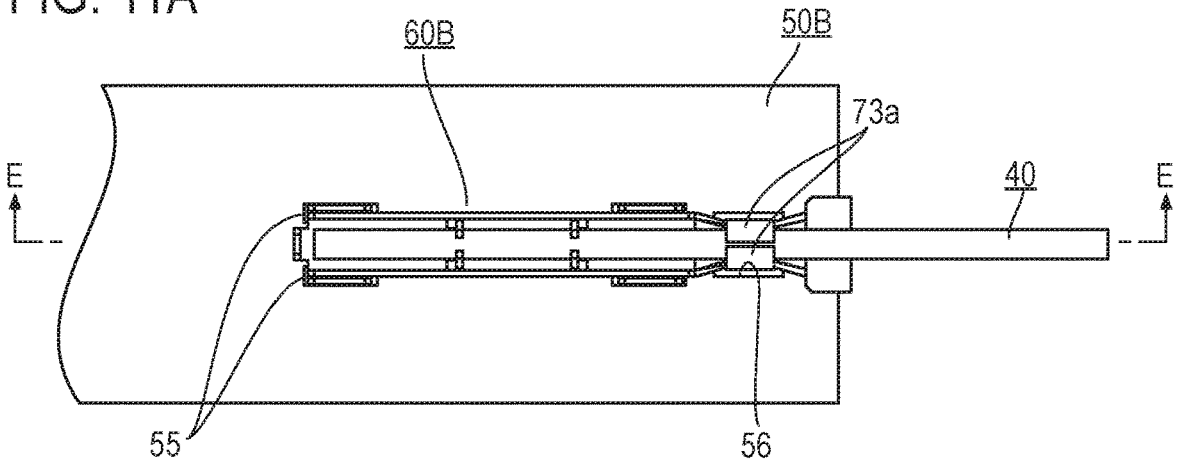
FIG. 11A is a plan view of the cable connection structure of the fourth embodiment.
Figure 11B:
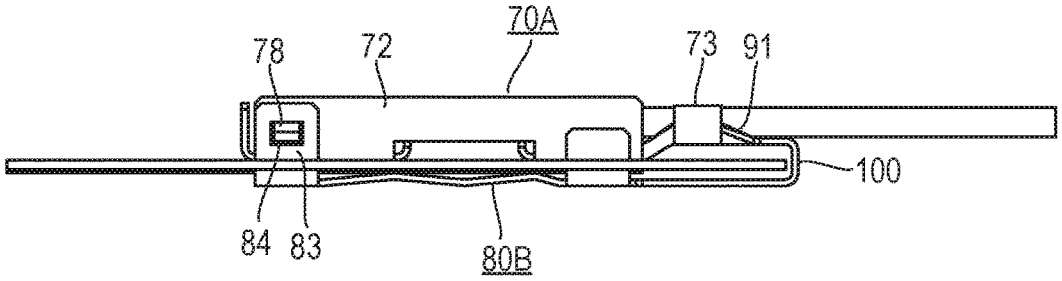
FIG. 11B is a front view of the cable connection structure of the fourth embodiment.
Figure 11C:
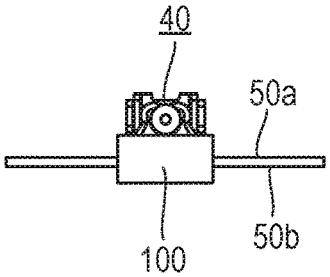
FIG. 11C is a right side view of the cable connection structure of the fourth embodiment.
Figure 11D:
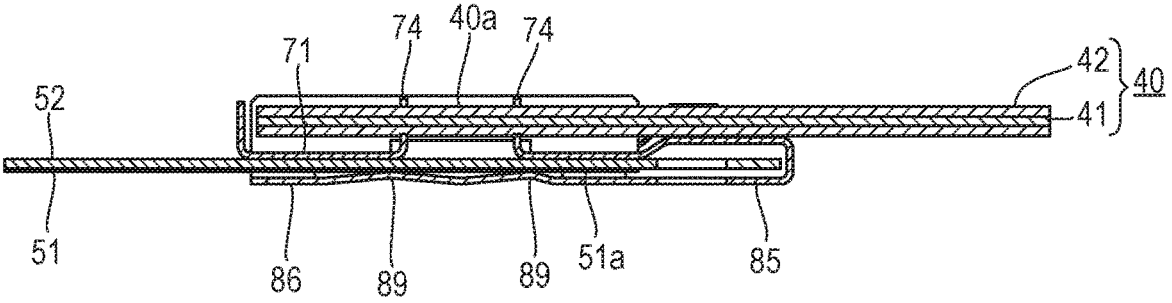
FIG. 11D is a sectional view taken along the line E-E in FIG. 11A.

FIGS. 9A and 9B illustrate a cable connection structure of a third embodiment. In this example, a conductor 51, to which a cable 40 is connected, is formed on a lower surface 50*b* of a wiring member 50A. A hole 54, positioning holes 55, and a hole for passage 56 in the third embodiment are the same as those of the first and second embodiments.

A cable junction connector 60A in the third embodiment is identical to the cable junction connector 60A in the second embodiment. An upper fitting 70 is disposed on an upper surface 50*a* of the wiring member 50A, and a lower fitting 80A is disposed on the lower surface 50*b* of the wiring member 50A.

A connection end 51*a* of the conductor 51 of the wiring member 50A is pressed by a protrusion 82 of the lower fitting 80A and consequently enters between two contact pieces 76*a* and 76*b* of the upper fitting 70 along with the protrusion 82. In this example, as illustrated in FIG. 9B, the connection end 51*a* does not come into contact with the contact piece 76*a*. However, the elasticity of the protrusion 82 causes the protrusion 82 to come into contact with the connection end 51*a* and the contact piece 76*b*, which electrically connects the connection end 51*a* to the upper fitting 70 via the protrusion 82. Therefore, the conductor 51 is electrically connected to the cable 40 via the upper fitting 70.

Fourth Embodiment

FIGS. 10A and 10B and FIGS. 11A to 11D illustrate a cable connection structure of a fourth embodiment. FIG. 12 is an exploded view of the cable connection structure illustrated in FIGS. 10A and 10B.

In the fourth embodiment, a cable junction connector 60B is a single part and has a structure in which an upper fitting 70A, which is disposed on an upper surface 50*a* of a wiring member 50B, and a lower fitting 80B, which is disposed on a lower surface 50*b* of the wiring member 50B, are coupled by a coupling portion 100.

The upper fitting 70A includes a bottom plate portion 71, side plate portions 72, insulation-displacement contacts 74, and an insulation barrel 73 like the upper fitting 70 in the first to third embodiments and further includes an extension portion 91 extending backward from the insulation barrel 73. The extension portion 91 is coupled to the coupling portion 100. Hooks 78 are formed only at the front ends of the two side plate portions 72 in the longitudinal direction thereof, that is, at the ends away from the insulation barrel 73. At the front ends, a front plate portion 92 that covers the front end of the upper fitting 70A is formed. The front plate portion 92 is bent and raised from the bottom plate portion 71.

The lower fitting 80B includes a base 85 coupled to the coupling portion 100, a plate portion 86 extending from the base 85, and two locking pieces 83 protruding from the tip of the plate portion 86 toward the upper fitting 70A. The plate portion 86 has the shape of a long and narrow cantilever. The two locking pieces 83 are located at both ends of the plate portion 86 in a width direction thereof, that is, a direction perpendicular to a longitudinal direction of the plate portion 86 and face each other in the width direction of the plate portion 86. Furthermore, two guide pieces 87 protruding toward the upper fitting 70A are formed at the base end of the plate portion 86.

A hole 88 for passage of a crimp tool is formed in the base 85 of the lower fitting 80B. A window 84 is formed in each of the two locking pieces 83. Two protrusions 89 protruding toward the upper fitting 70A as a result of the plate portion 86 being bent are arranged in the longitudinal direction of the plate portion 86.

A conductor 51 is formed on the lower surface 50*b* of the wiring member 50B. Like the wiring member 50 in the first embodiment, for example, positioning holes 55 and a hole for passage 56 are formed in the wiring member 50B.

The cable junction connector 60B is attached to the wiring member 50B by sandwiching the wiring member 50B between the upper fitting 70A and the lower fitting 80B. The locking pieces 83 and the guide pieces 87 of the lower fitting 80B pass through the positioning holes 55 of the wiring member 50B. The hooks 78 of the side plate portions 72 are engaged in the windows 84 of the locking pieces 83; consequently, the cable junction connector 60B is attached to the wiring member 50B. The elasticity of the protrusions 89 formed in the plate portion 86 of the lower fitting 80B causes the protrusions 89 to come into good contact with the conductor 51 or the connection end 51*a* thereof, which makes it possible to electrically connect the conductor 51 and a cable 40 via the cable junction connector 60B.

Also in the fourth embodiment, the cable connection structure in which the cable 40 is connected to the wiring member 50B is obtained by pushing the lower fitting 80B, the upper fitting 70A, and the cable 40 into one another vertically, that is, in one direction in a state in which the wiring member 50B is sandwiched between the lower fitting 80B and the upper fitting 70A, or is obtained by one simple operation. The front plate portion 92 of the cable junction connector 60B functions as a stopper for the tip of the cable 40 which is housed between the two side plate portions 72.

Modification

In the first to fourth embodiments, in place of the side plate portions 72, pieces-to-be-locked that are interlocked with the locking pieces 83 may be formed in the upper fittings 70 and 70A. In the first to fourth embodiments, hooks may be formed in the locking pieces 83 and windows in which the crimp wings are engaged may be formed in the pieces-to-be-locked. The base of the sheet-like wiring member is not limited to a fabric; the base of the sheet-like wiring member may be, for example, a resin film, that is, a flexible printed circuit (FPC). Alternatively, the base of the sheet-like wiring member may be a rigid base. The cable has a structure including a linear conductor for transmitting electricity; specifically, the cable includes a linear conductor covered with an insulator or a linear conductor covered with an insulator and a protective covering. The cable is not limited to an insulated wire; the cable may be, for example, an enameled wire or a fabric cable into which a conductive thread is woven. The cable junction connector may be attached at some midpoint in the cable, not at an end of the cable. The cable junction connector may be attached, not at an end of the conductor formed on the sheet-like wiring member, but at some midpoint in the conductor.

The first to fourth embodiments are not mutually exclusive. A feature of one embodiment may be applied to a feature of the other embodiment unless a contradiction arises from a technical standpoint. For example, the hole 54 described in the first embodiment may be formed in the upper fitting 70A in the fourth embodiment and the protrusion 82 described in the first embodiment may be formed in the lower fitting 80B in the fourth embodiment. Alternatively, the protrusions 89 described in the fourth embodiment may be formed in the lower fitting 80 in the first embodiment, or the bent portion 81*a* described in the second embodiment may be formed in the lower fitting 80B in the fourth embodiment.

Addendum

While the invention has been described with reference to exemplary embodiments, it will be understood by those skilled in the art that various changes may be made and equivalents may be substituted for elements thereof without departing from the scope of the invention. In addition, many modifications may be made to adapt a particular system, device or component thereof to the teachings of the invention without departing from the essential scope thereof. Therefore, it is intended that the invention not be limited to the particular embodiments disclosed for carrying out this invention, but that the invention will include all embodiments falling within the scope of the appended claims.

Moreover, the use of the terms "first", "second", etc. do not denote any order or importance, but rather the terms "first", "second", etc. are used to distinguish one element from another. The terminology used herein is for the purpose of describing particular embodiments only and is not intended to limit the invention in any way. As used herein, the singular forms "a", "an" and "the" are intended to include the plural forms as well, unless the context clearly indicates otherwise. It will be further understood that the terms "comprise", "comprises", and/or "comprising," when used in this specification and/or the appended claims, specify the presence of stated features, steps, operations, elements, and/or components, but do not preclude the presence or addition of one or more other features, steps, operations, elements, components, and/or groups thereof. The term "and/or", if any, includes any and all combinations of one or more of the associated listed items. In the claims and the specification, unless otherwise noted, "connect", "join", "couple", "interlock", or synonyms therefor and all the word forms thereof do not necessarily deny the presence of one or more intermediate elements between two elements, for instance, two elements "connected" or "joined" to each other or "interlocked" with each other.

Unless otherwise defined, all terms (including technical and scientific terms) used herein have the same meaning as commonly understood by those skilled in the art to which the invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual techniques or steps in an unnecessary fashion. Nevertheless, the specification and claims should be read with the understanding that such combinations are entirely within the scope of the invention and the claims.

The corresponding structures, materials, acts, and equivalents of all means or step plus function elements in the claims below, if any, are intended to include any structure, material, or act for performing the function in combination with other claimed elements as specifically claimed.

The foregoing description of the embodiments of the invention has been presented for the purpose of illustration and description. It is not intended to be exhaustive and to limit the invention to the precise form disclosed. Modifications or variations are possible in light of the above teaching. The embodiments were chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A cable connection structure comprising:

a cable;

a sheet-like wiring member; and a cable junction connector, the cable including a linear conductor and a covering portion covering the linear conductor, the cable junction connector including a first fitting and a second fitting, the first fitting including a plate portion, an insulation-displacement contact including an open-ended slot, and a connection portion, the second fitting including a plate portion and a connection portion having a structure allowing the connection portion to be interlocked with the connection portion of the first fitting, the sheet-like wiring member including a conductor formed on the sheet-like wiring member, the connection portion of the first fitting and the connection portion of the second fitting interlocking with each other with a part of the conductor sandwiched between the plate portion of the first fitting and the plate portion of the second fitting, the cable being secured to the first fitting with the cable pressed into the slot, the linear conductor and the insulation-displacement contact being in contact with each other, the linear conductor being exposed from the covering portion peeled off by the open-ended slot, a press direction of the cable to the open-ended slot being perpendicular to a direction of the cable extending and being parallel to a direction of the plate portion of the first fitting and the plate portion of the second fitting sandwiching the part of the conductor.

2. The cable connection structure according to claim 1, wherein the plate portion of the second fitting has a bend that causes the plate portion of the second fitting to become warped in a direction in which the plate portion of the second fitting moves away from the sheet-like wiring member or a bend that is bent toward the sheet-like wiring member.

3. The cable connection structure according to claim 2, wherein the plate portion of the first fitting and the plate portion of the second fitting are coupled to each other.

4. The cable connection structure according to claim 3, wherein the sheet-like wiring member has a through hole, the conductor has an end located in the through hole of the sheet-like wiring member, the plate portion of the first fitting has a through hole, the plate portion of the second fitting has a folded portion, and the folded portion is inserted into the through hole of the sheet-like wiring member and the through hole of the first fitting, and the end, which is bent by the folded portion, of the conductor is in contact with an edge of the through hole of the sheet-like wiring member or the folded portion, in a state in which the part of the conductor is sandwiched between the plate portion of the first fitting and the plate portion of the second fitting.

5. The cable connection structure according to claim 2, wherein the sheet-like wiring member has a through hole, the conductor has an end located in the through hole of the sheet-like wiring member, the plate portion of the first fitting has a through hole, the plate portion of the second fitting has a folded portion, and the folded portion is inserted into the through hole of the sheet-like wiring member and the through hole of the first fitting, and the end, which is bent by the folded portion, of the conductor is in contact with an edge of the through hole of the sheet-like wiring member or the folded portion, in a state in which the part of the conductor is sandwiched between the plate portion of the first fitting and the plate portion of the second fitting.

6. The cable connection structure according to claim 1, wherein the plate portion of the first fitting and the plate portion of the second fitting are coupled to each other.

7. The cable connection structure according to claim 1, wherein the sheet-like wiring member has a through hole, the conductor has an end located in the through hole of the sheet-like wiring member, the plate portion of the first fitting has a through hole, the plate portion of the second fitting has a folded portion, and the folded portion is inserted into the through hole of the sheet-like wiring member and the through hole of the first fitting, and the end, which is bent by the folded portion, of the conductor is in contact with an edge of the through hole of the sheet-like wiring member or the folded portion, in a state in which the part of the conductor is sandwiched between the plate portion of the first fitting and the plate portion of the second fitting.

8. The cable connection structure according to claim 6, wherein the sheet-like wiring member has a through hole, the conductor has an end located in the through hole of the sheet-like wiring member, the plate portion of the first fitting has a through hole, the plate portion of the second fitting has a folded portion, and the folded portion is inserted into the through hole of the sheet-like wiring member and the through hole of the first fitting, and the end, which is bent by the folded portion, of the conductor is in contact with an edge of the through hole of the sheet-like wiring member or the folded portion, in a state in which the part of the conductor is sandwiched between the plate portion of the first fitting and the plate portion of the second fitting.

* * * * *